US008328692B2

(12) United States Patent
Lin

(10) Patent No.: US 8,328,692 B2
(45) Date of Patent: Dec. 11, 2012

(54) SELF-GENERATING RESISTANCE APPARATUS FOR FITNESS AND REHABILITATION EQUIPMENTS

(76) Inventor: Lily Lin, Yilan County (TW)

( * ) Notice: Subject to any disclaimer, the term of this patent is extended or adjusted under 35 U.S.C. 154(b) by 35 days.

(21) Appl. No.: 13/099,573

(22) Filed: May 3, 2011

(65) Prior Publication Data

US 2012/0283068 A1 Nov. 8, 2012

(51) Int. Cl.
*A63B 71/00* (2006.01)

(52) U.S. Cl. ..... 482/2; 482/1; 482/8; 482/901

(58) Field of Classification Search ..... 482/1–9, 482/900–902; 434/247
See application file for complete search history.

(56) References Cited

U.S. PATENT DOCUMENTS 7,267,637 B2 * 9/2007 Mercado et al. ..... 482/52
7,504,737 B2 * 3/2009 Vasilovich et al. ..... 290/1 R
2010/0144496 A1 * 6/2010 Schmidt ..... 482/70

* cited by examiner

*Primary Examiner* — Glenn Richman
(74) *Attorney, Agent, or Firm* — Rosenberg, Klein & Lee

(57) ABSTRACT

A self-generating resistance apparatus for fitness and rehabilitation equipments comprises a bracket, a flywheel, a power generator, a belt and a resistance mechanism. The flywheel is rotating mechanism that provides inertia, and has a transmission shaft coupled to the power source of the fitness or rehabilitation equipment, and an external ring coupled to a pulley of the power generator by a belt. When a user steps on an exercise mechanism of the equipment, the flywheel drives the power generator to rotate and generate electric current. Since the power generator is installed outside the flywheel, the difference between the diameters of the pulley and the external ring causes a very large rotating speed ratio, and a large power approaching to the power generated by a large power generator can be produced.

10 Claims, 11 Drawing Sheets

SELF-GENERATING RESISTANCE APPARATUS FOR FITNESS AND REHABILITATION EQUIPMENTS

BACKGROUND OF THE INVENTION (a) Field of the Invention

The present invention relates to a self-generating resistance apparatus for fitness and rehabilitation equipments, and more particularly to an apparatus that installs a power generator at a flywheel externally to increase the rotating speed ratio to produce a large power, and supply an electric current to a solenoid to produce a reverse resistance to the rotating flywheel, so as to achieve the exercise effect.

(b) Description of the Related Art

At early stage, American fitness equipments directly used an automobile power generator as a resistance system, but such application was unable to comply with the special requirements of the fitness equipments, and thus improvements were made as follows.

The first model is a resistance system in form of a pure power generator as shown in FIGS. 1A and 1B, wherein an inertia flywheel 12 and an iron core 14 are installed on a shaft 11, and a power generating coil 15 is wound around the circumference of the iron core 14, such that when the inertia flywheel 12 and a permanent magnet 13 installed at the internal periphery of the inertia flywheel 12 are rotated, a power generator 10 is formed. Related technologies of this sort are disclosed in U.S. Pat. Nos. 4,775,145, 5,558,624, and 5,236,069, but these prior arts have the following drawbacks:

1. Since the source of resistance is produced by connecting the power of the power generator in a reverse direction, and the original power generator is short-circuited to produce a braking effect whenever a resistance is required. A greater braking force and a greater rotating speed ratio are required for the design, thus incurring a higher level of difficulty for the manufacture.

2. A multiple of harmonic waves of the reversely connected power supply as described in the first drawback produce significant vibrations and noises at a high rotating speed.

3. A portion of the power generated by the power generator is consumed, so that it is necessary to install a large resistor to consume the remaining portion of the power, thus incurring a higher cost and a lower efficiency.

The second model is a mixed-type power generator that adds a solenoid 16 and an iron core 17 onto an external side of the inertia flywheel as shown in FIGS. 2A and 2B. The structure of this sort is disclosed in U.S. Pat. No. 6,084,325, and the remaining portion of the power of the pure power generator is used for producing a braking force to achieve the required resistance for the fitness equipments and rehabilitation equipments. Although this mixed-type power generator can overcome the high cost and low efficiency of the pure power generator, yet it has the following drawbacks:

1. The mixed-type power generator comes with a fixed structure. Since a constant air gap is kept between the solenoid 16 and the iron core 17 and the inertia flywheel 12 for high performance, therefore the size of the power generator cannot be varied freely according to user requirements.

2. Since the iron core 14 of the power generator and the iron core 17 of the solenoid 16 are two separate systems, therefore the price will be higher.

3. The solenoid 16 is an independent component installed outside the inertia flywheel 12, so that the volume will be larger, which is unfavorable for the overall design of an automobile The third model is also a mixed-type power generator, wherein a solenoid 16 and an iron core 17 are installed on the internal side of the inertia flywheel as shown in FIGS. 3A and 3B. The structure of this sort is disclosed in U.S. Pat. No. 7,732,961. Although this model can overcome most of the drawbacks of the second model, yet the power generator adopts a large pulley to drive a small pulley of the fitness equipments or rehabilitation equipments by a one-step transmission method, so that the rotating speed ratio is generally less than 1:20 which is relatively low. Since the efficiency of the power generator is related to the rotating speed of the power generator closely, therefore if the power generator has a high rotating speed, then it will output a high power; and if the power generator has a low rotating speed, then it will output a low power. Obviously, the rotating speed of the aforementioned three models of power generators is limited, thus failing to maximize the efficiency of their applications.

SUMMARY OF THE INVENTION

It is a primary objective of the present invention to provide a power generator installed outside an inertia flywheel and adopts an indirect transmission to drive and rotate the power generator, so as to increase the rotating speed and improve the efficiency of the power generator.

Another objective of the present invention is to use a solenoid and an iron core to provide the required exercise resistance, and the solenoid and the iron core are designed with an appropriate size to fit the size of the inertia flywheel and installed on an internal side or an external side of the flywheel selectively to facilitate a flexible manufacture of the fitness equipments and rehabilitation equipments.

In order to achieve the above-mentioned objects, the invention includes:

a bracket, formed by assembling an internal plate and an external plate, and having an upper end with a shaft hole formed thereon and a lower end fixed to a frame of a fitness equipment or a rehabilitation equipment;

a flywheel, being a rotating means for providing inertia, and having an external ring and a hub, and a ring groove being formed at an external edge of the external ring;

a rotating axle, passed into a hub of the flywheel, and having a bearing and a bearing seat installed on the rotating axle, and the rotating axle being installed into the shaft hole of the bracket, and an end of the rotating axle having a driven wheel driven by a driving wheel of the fitness equipment or the rehabilitation equipments for driving the rotating axle and the flywheel to rotate;

a power generator, installed outside the flywheel, and having a shaft and a power generator, and the power generator further having a pulley fixed to an external side of the power generator, and both ends of the shaft being secured onto the internal and external plates of the bracket respectively; and a belt, mounted onto the ring groove of the flywheel and the pulley of the power generator, such that the flywheel can drive the power generator to rotate and generate an electric current;

thereby, a user of the fitness equipment or the rehabilitation equipment can step on the equipment, and the kinetic energy is transmitted from the flywheel to the power generator, and the external ring of the flywheel has a diameter much greater than the diameter of the pulley of the power generator, such that when the flywheel rotates, a large speed ratio between the power generator and the flywheel is formed, and the electric current generated by the power generator is increased correspondingly;

a resistance mechanism, including a braking iron core and a solenoid, and the braking iron core having an E-shaped containing portion concavely formed on an internal surface of the braking iron core and provided for installing the solenoid, and the resistance mechanism being installed at the periphery of the flywheel, and the electric current generated by the power generator being supplied to the solenoid, the braking iron core and the flywheel to produce a closed magnetic circuit, so as to produce a reverse resistance to the rotating flywheel.

According to the above-mentioned technical features, the power generator comprises a magnet cover, which is a hollow ring with a permanent magnet installed inside the hollow ring, and a front cover and a rear cover are mounted onto both distal surfaces at both ends of the magnet cover respectively, and an external side of the front cover and the pulley are combined into one piece, and a bearing hole is formed at the center of each of the front and rear covers for installing a bearing, and the bearing is installed onto the shaft, such that the magnet forms a rotor; a stator, fixed onto the shaft, and having a power generating coil wound around the external periphery of the stator, such that the pulley is driven by the flywheel through the belt, and the magnet inside the magnet cover is rotated together with the pulley, and the magnetic field is changed, such that the electromagnetic force induced by the power generating coil in the stator to generate an electric current.

Moreover, the braking iron core and the solenoid of the resistance mechanism come with one set or plural sets and the resistance mechanism is installed inside the flywheel, and a small gap is formed between an external surface of the braking iron core and an external surface of the external ring of the flywheel.

Furthermore, the resistance mechanism is installed outside the flywheel, such that a small gap is formed between an external surface of the braking iron core and an external surface of the external ring of the flywheel. In addition, the braking iron core is secured onto the bracket.

DETAILED DESCRIPTION OF THE PREFERRED EMBODIMENT

Figure 1B:
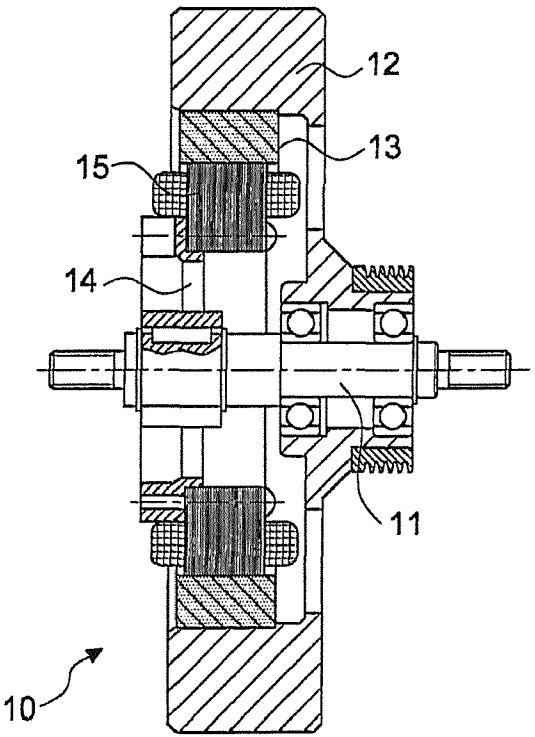
FIG.1B PRIOR ART
FIGS. 1A and 1B are schematic views of a conventional power generation structure.
Figure 1A:
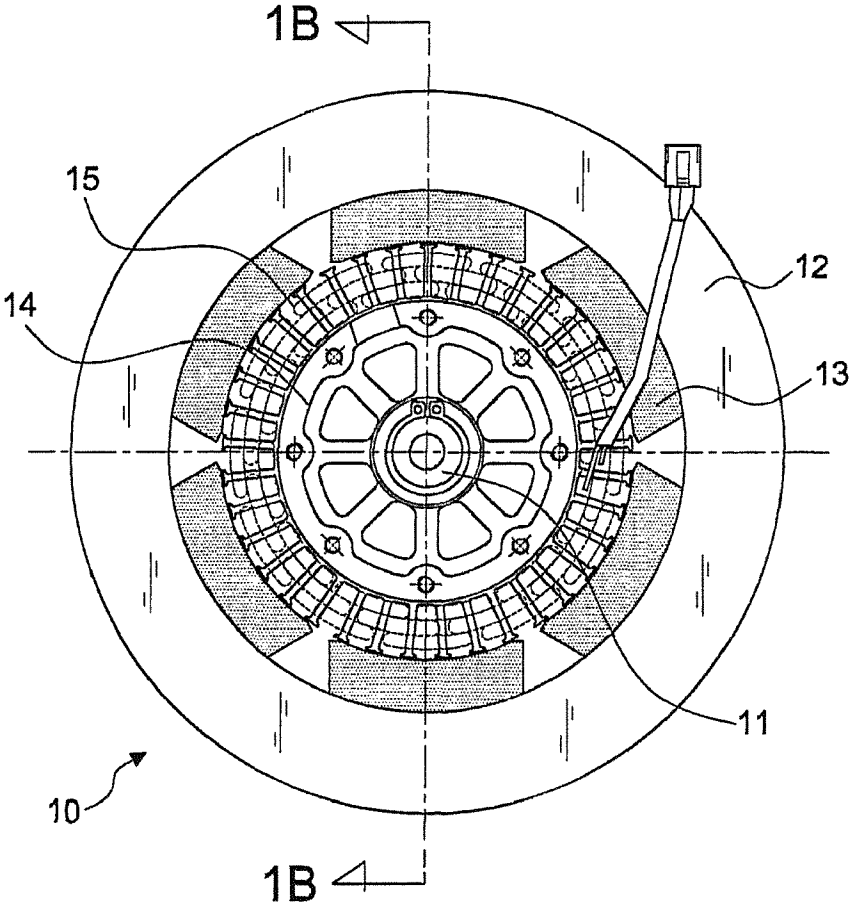
FIG.1A PRIOR ART
Figure 2B:
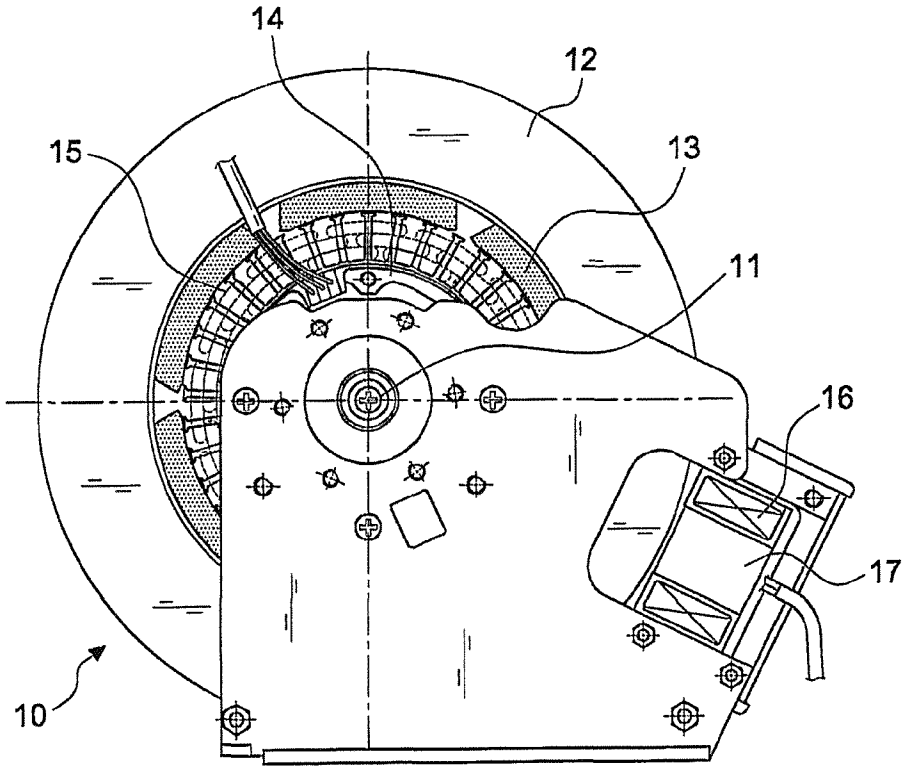
FIG.2B PRIOR ART
FIGS. 2A and 2B are schematic views of a conventional mixed structure with an externally installed solenoid.
Figure 2A:
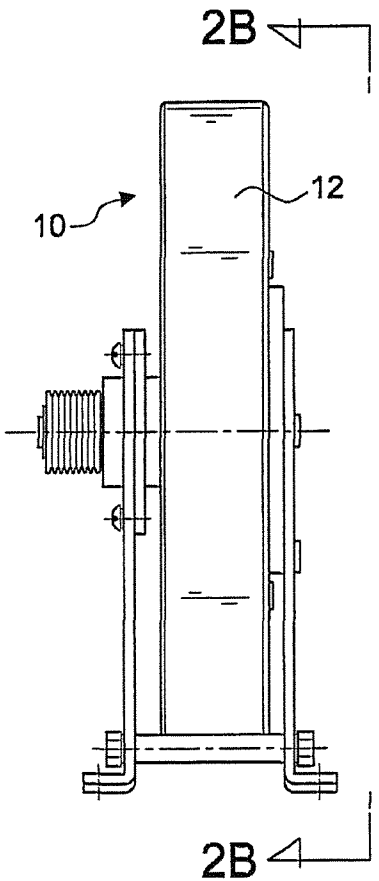
FIG.2A PRIOR ART
Figure 3B:
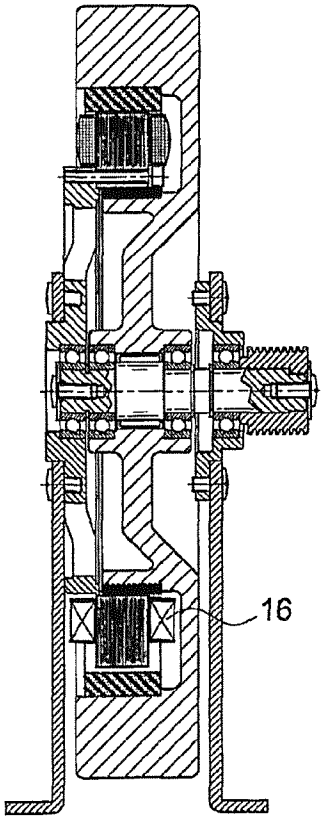
FIG.3B PRIOR ART
FIGS. 3A and 3B are schematic views of a conventional mixed structure with an internally installed solenoid.
Figure 3A:
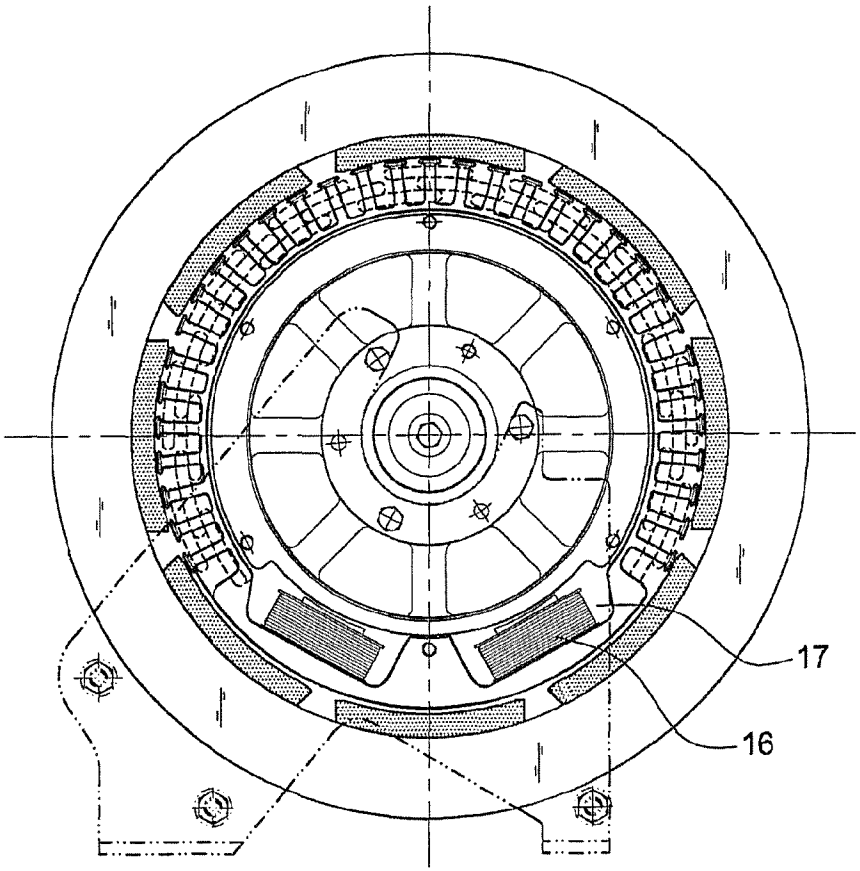
FIG.3A PRIOR ART
Figure 4:
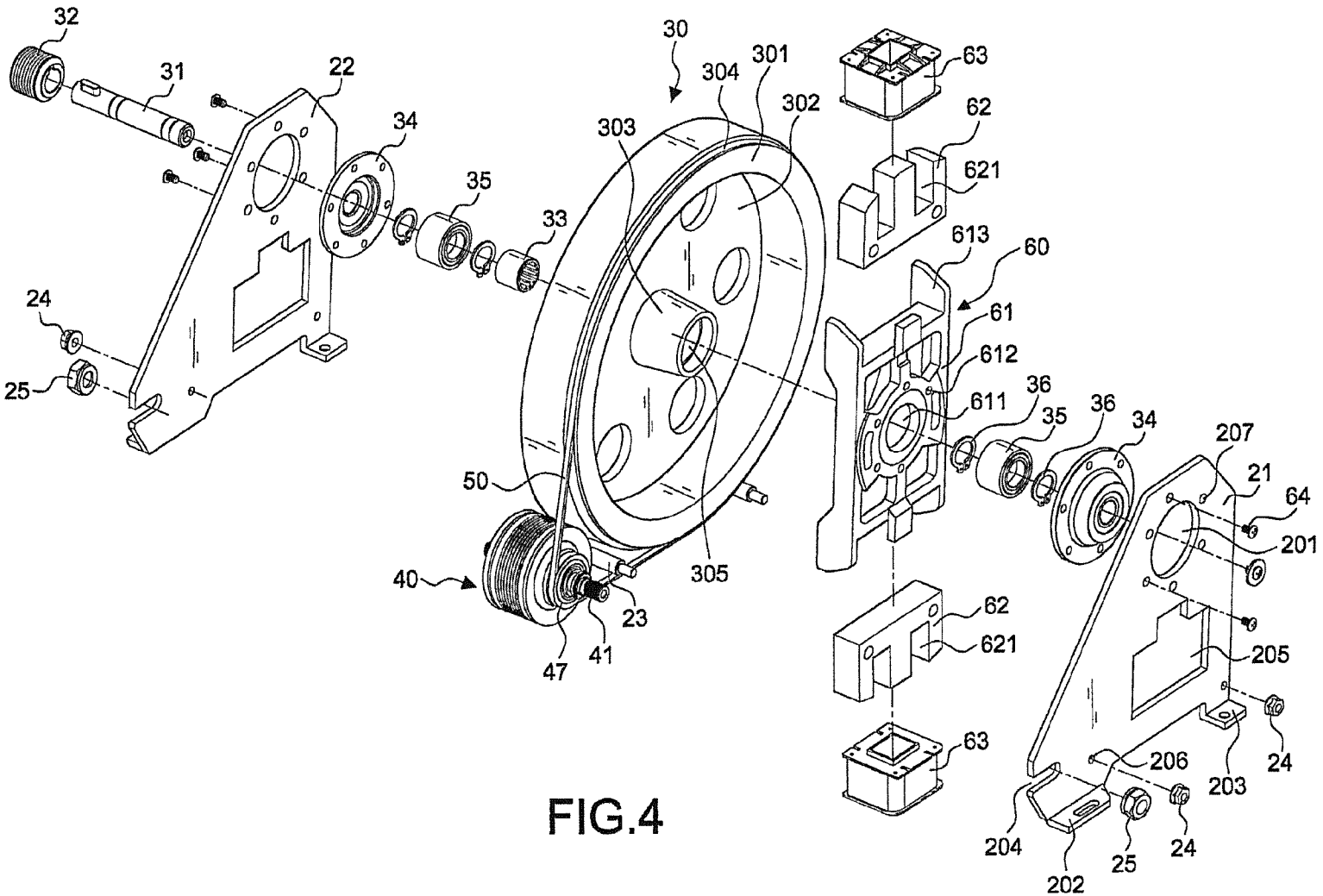
FIG. 4 is an exploded view of a first preferred embodiment of the present invention.
Figure 5:
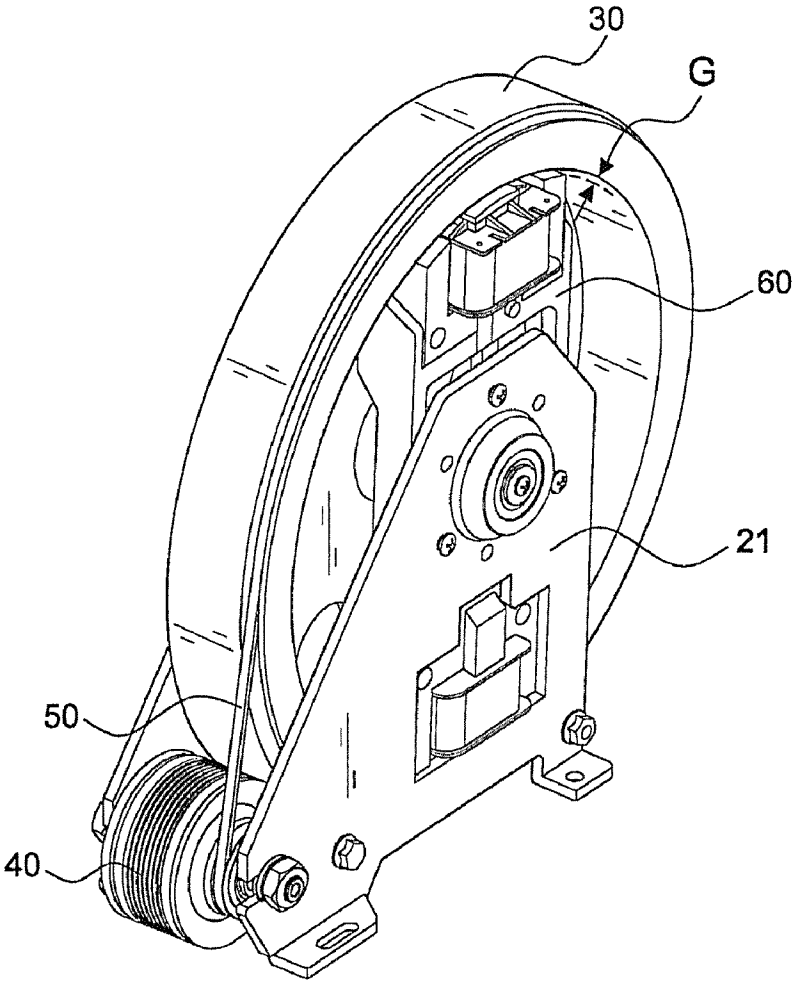
FIG. 5 is a perspective view of a first preferred embodiment of the present invention.

With reference to FIGS. 4 to 8 for a first preferred embodiment of the present invention, the first preferred embodiment comprises the following elements:

A bracket 20 is formed by assembling an internal plate 21 and an external plate 22, and an upper end of the bracket 20 has a shaft hole 201 formed thereon, and six fixing holes 207 are formed equidistantly around the periphery of the shaft hole 201. A front foot base 202 and a rear foot base 203 are formed at the lower end of the external plates 21, 22 and fixed to the frame of the fitness or rehabilitation equipment by screws or soldering; an open slot 204 is formed at the front of the bracket 20. A maintenance hole 205 and two positioning holes 206 are formed on the bracket 20, and threads are formed at both ends of two positioning rods 23, and each positioning rod 23 is secured into the positioning hole 206 by a nut 24, such that the internal and external plates 21, 22 can be combined into one piece.

A flywheel 30 is a rotating means that provides inertia and has an external ring 301 and an internal wall 302, wherein a hub 303 with a shaft hole 305 is formed at the center of the internal wall 302, and a ring groove 304 is formed at an external edge of the external ring 301.

A rotating axle 31 includes a one-way bearing 33 installed at the middle section of the rotating axle 31 and coupled to the shaft hole 305 of the flywheel 30, and a driven wheel 32 is installed at an end of the rotating axle 31 and disposed at both sides of the hub 303 of the flywheel 30 separately, and each driven wheel 32 includes a ball bearing 35, and a bearing seat 34 sheathed on the external periphery of the ball bearing 35, and the bearing seats 34 at both front and rear ends are secured into the shaft holes 201 of the external plates 21, 22 respectively. The middle section of the rotating axle 31 is coupled to the flywheel 30 by the one-way bearing 33, and both ends of the rotating axle 31 are fixed to the internal and external plates 21, 22 by the bearing seats 34 respectively, and an end of the rotating axle 31 is extended to an external side of the external plate 22 and coupled to the driven wheel 32, such that after the driven wheel 32 of the fitness and rehabilitation equipment is pedaled, driven, and rotated, the rotating axle 31 is driven to rotate the flywheel 30 on the bracket 20.

Figures 8A, 8B:
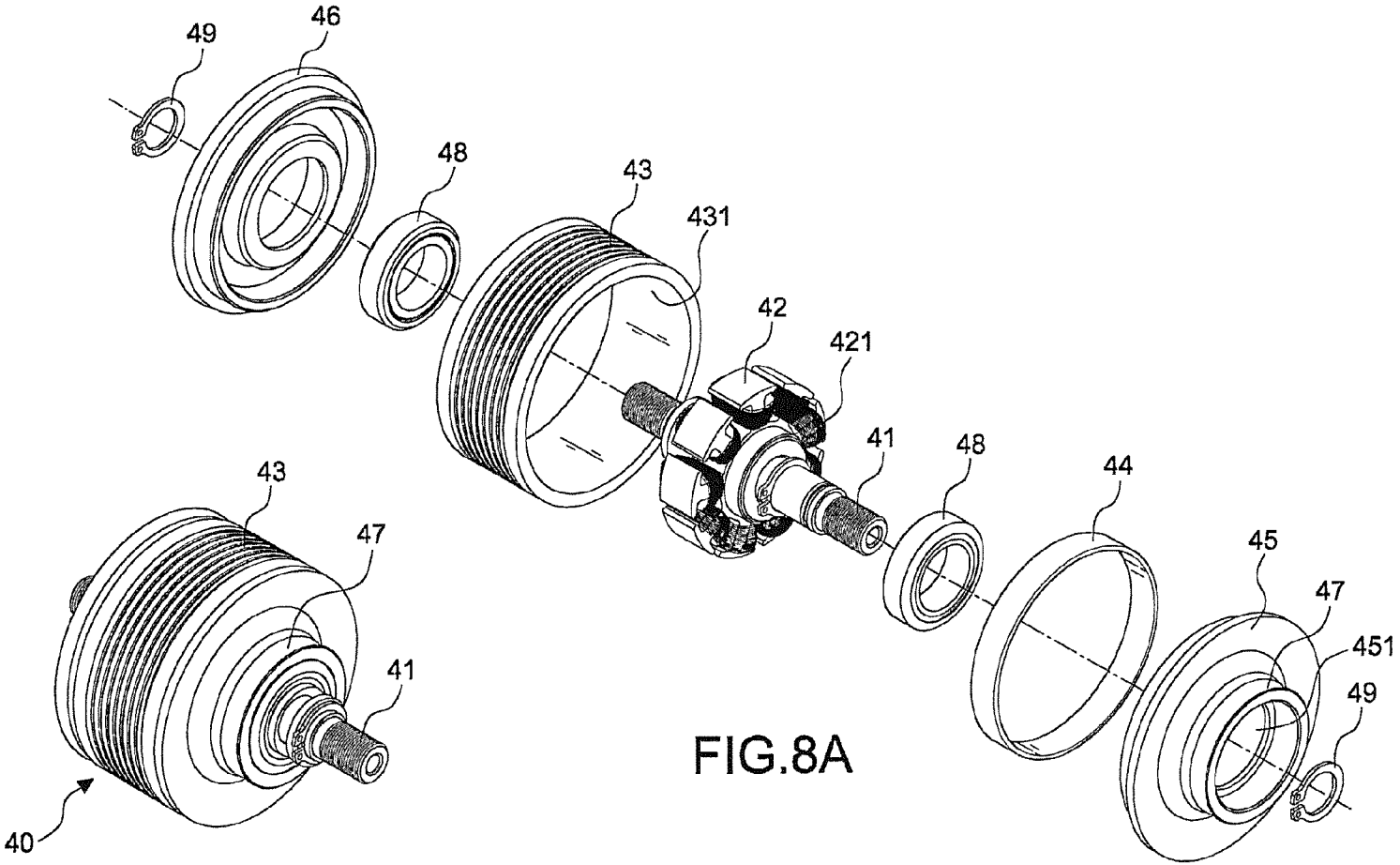
FIG. 8A is an exploded view of a power generator in accordance with the present invention.
FIG. 8B is a perspective view of a power generator in accordance with the present invention.

A power generator 40 with a structure as shown in FIGS. 8A and 8B comprises: a shaft 41 having threads at both ends of the shaft 41, a stator iron core 42 fixed to the middle section of the shaft 41, and a power generating coil 421 wound around the external periphery of the stator iron core 42; a magnet cover 43, which is a hollow ring 431, wherein a permanent magnet 44 is installed in the hollow ring 431, such that after the magnet cover 43 is combined with the magnet 44, the magnet cover 43 is sheathed on the external periphery of the stator iron core 42; a front cover 45 and a rear cover 46 fixed onto both distal surfaces of the magnet cover 43, and a pulley 47 fixed to an external side of the front cover 45; a bearing hole 451 formed at the center of the rear covers 45, 46, and a ball bearing 48 installed between the bearing hole 451 and the shaft 41, and during the installing process, both sides of the ball bearing 48 are fixed into positions by a C-ring 49 separately, so that the magnet cover 43 and the magnet 44 form a rotor that can be rotated in the shaft 41. Both ends of the shaft 41 of the assembled power generator 40 are installed into the open slots 204 of the internal and external plates 21, 22, and a washer and a nut 25 are used for fixing the power generator 40 onto the bracket 20.

A belt 50 is installed into the ring groove 304 of the flywheel 30 and mounted onto the pulley 47 of the power generator 40. After the position of the open slot 204 of the bracket 20 at the shaft 41 of the power generator 40 is confirmed, and the tightness of the belt 50 is adjusted appropriately, the nut 25 is secured, such that the flywheel 30 can be driven by the pulley 47 of the power generator 40 through the belt 50.

A resistance mechanism 60 comprises a braking iron core bracket 61 which is a rectangular frame and has a center hole 611 formed at the center of the braking iron core bracket 61, and a screw hole 612 formed around the periphery of the center hole 611 and matched with the fixing hole 207 of the internal plate 21; one or more sets of braking iron cores 62, each having an E-shaped containing portion 621 concavely formed at an internal surface of the braking iron core, and a solenoid 63 sheathed thereon. In this preferred embodiment, two sets of braking iron cores 62 and solenoids 63 are used and installed in the iron core seats 613 at both ends of the braking iron core bracket 61 respectively. The center hole 611 of the braking iron core bracket 61 is sheathed on the hub 303 on the internal wall 302 of the flywheel 30, and a fixing screw 64 is used for locking the fixing hole 207 of the internal plate 21 with the screw hole 612 of the braking iron core bracket 61 together, so that the resistance mechanism 60 can be fixed onto the internal side of the internal plate 21. In the meantime, a magnetic resistance effect is produced, and a magnetic gap G is formed between the braking iron cores 62 at both ends of the braking iron core bracket 61 and the internal surface of the external ring 301 of the flywheel 30.

Since the self-generating resistance apparatus of the present invention is installed to the fitness and rehabilitation equipments, a user can step on the pedals to drive a transmission component such as a belt or a chain of the equipment (not shown in the figure) for driving the driven wheel 32 comprised of a pulley or a chain wheel and installed on the transmission shaft 31 to rotate the flywheel 30. Then, the belt 50 mounted onto the external rim of the flywheel 30 will drive the pulley 47 of the power generator 40 to rotate the rotor (or the magnet 44) of the power generator 40 backward. Due to the change of magnetic field, the stator which is the power generating coil 421 induces an electromagnetic force to produce an electric current. However, the principle of electric power generation is a prior art, and thus will not be described in details here.

Figure 6:
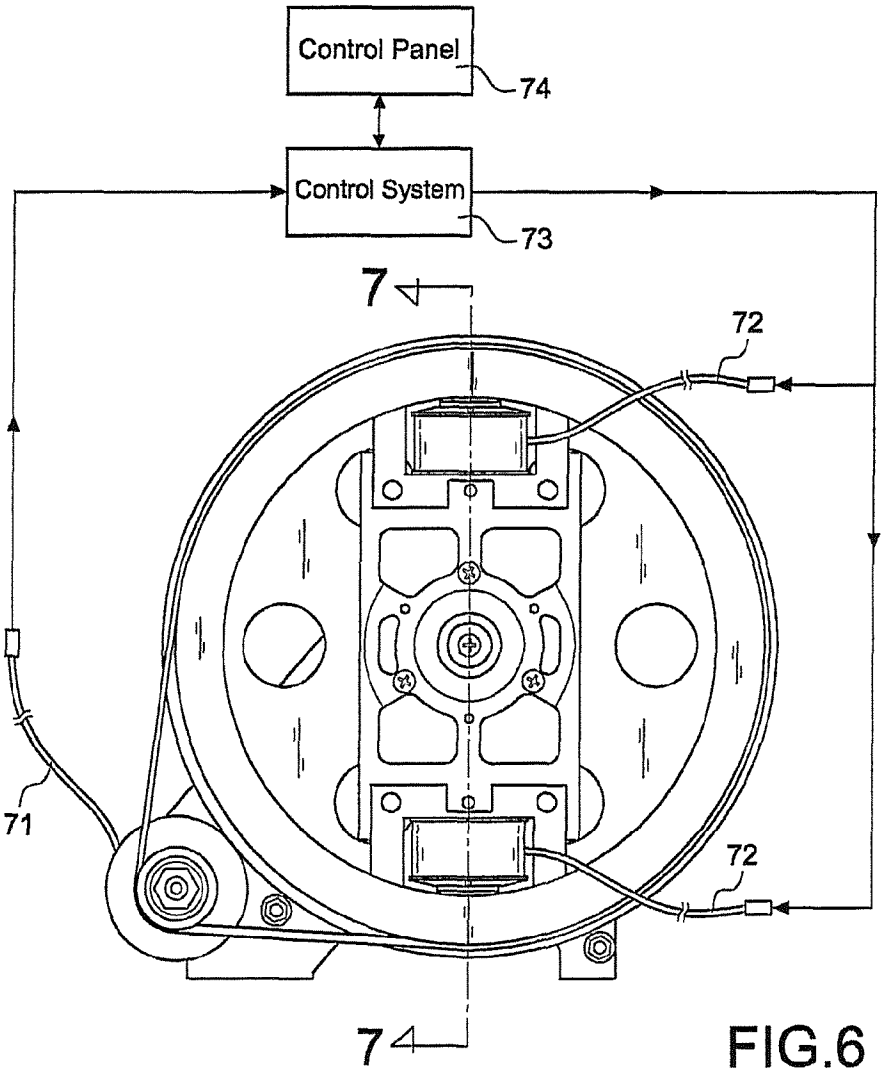
FIG. 6 is a front view of a first preferred embodiment of the present invention.
Figure 7:
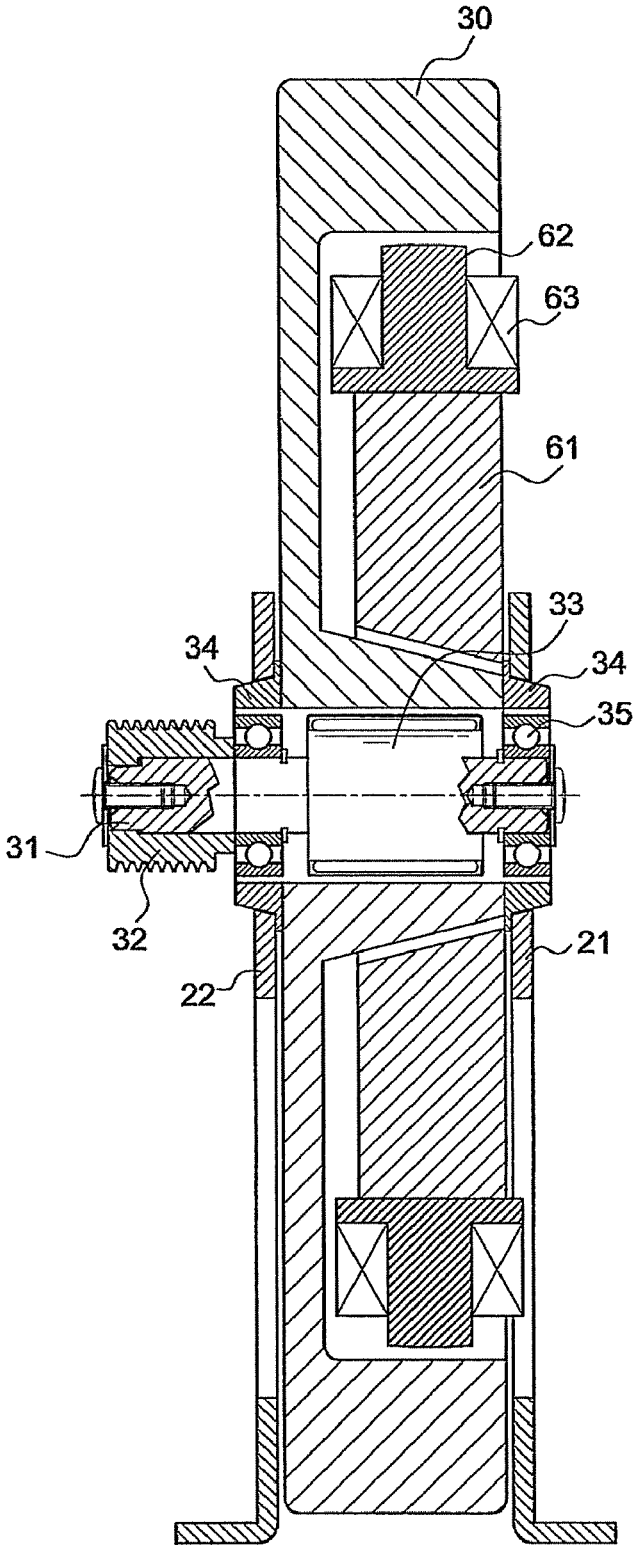
FIG. 7 is a cross-sectional view of a first preferred embodiment of the present invention.

In FIG. 6, the current generated by the power generating coil 421 is sent to a control system 73 through a current output line 71, and a portion of the current is supplied to a control panel 74 of the equipment, and the remaining portion of the current is supplied to the solenoid 63 through an input conductive line 72. In other words, the electric current is inputted from the solenoid 63, such that a magnetic field is induced in a reverse direction, and the magnetic material (not shown in the figure) on the internal surface of the external ring 301 of the flywheel 30 forms a closed magnetic circuit. Since the flywheel 30 is situated at a rotating status, the closed magnetic circuit may be damaged easily. According to Lenz's law, Eddy reluctance with the same magnitude and an opposite direction will be produced if a stable magnetic field is damaged by external forces, and the present invention will use such Eddy reluctance to form the exercise resistance of the fitness and rehabilitation equipment. The magnitude of the reverse resistance can be controlled by the current of the solenoid 63, and the control can be made and adjusted from the control system 73 and the control panel 74. However, this portion of the invention is not claimed, and thus will not be described in details here.

The magnetic material (not shown in the figure) is coated onto the internal surface of the external ring 301 of the flywheel 30. The present invention is not limited to such arrangement only, and the magnetic material can be formed onto the external ring 301 of the flywheel 30 directly. In other words, the magnetism of the material of the external ring 301 can be used for achieving the effect of producing the closed magnetic circuit by the solenoid 63.

Figure 9:
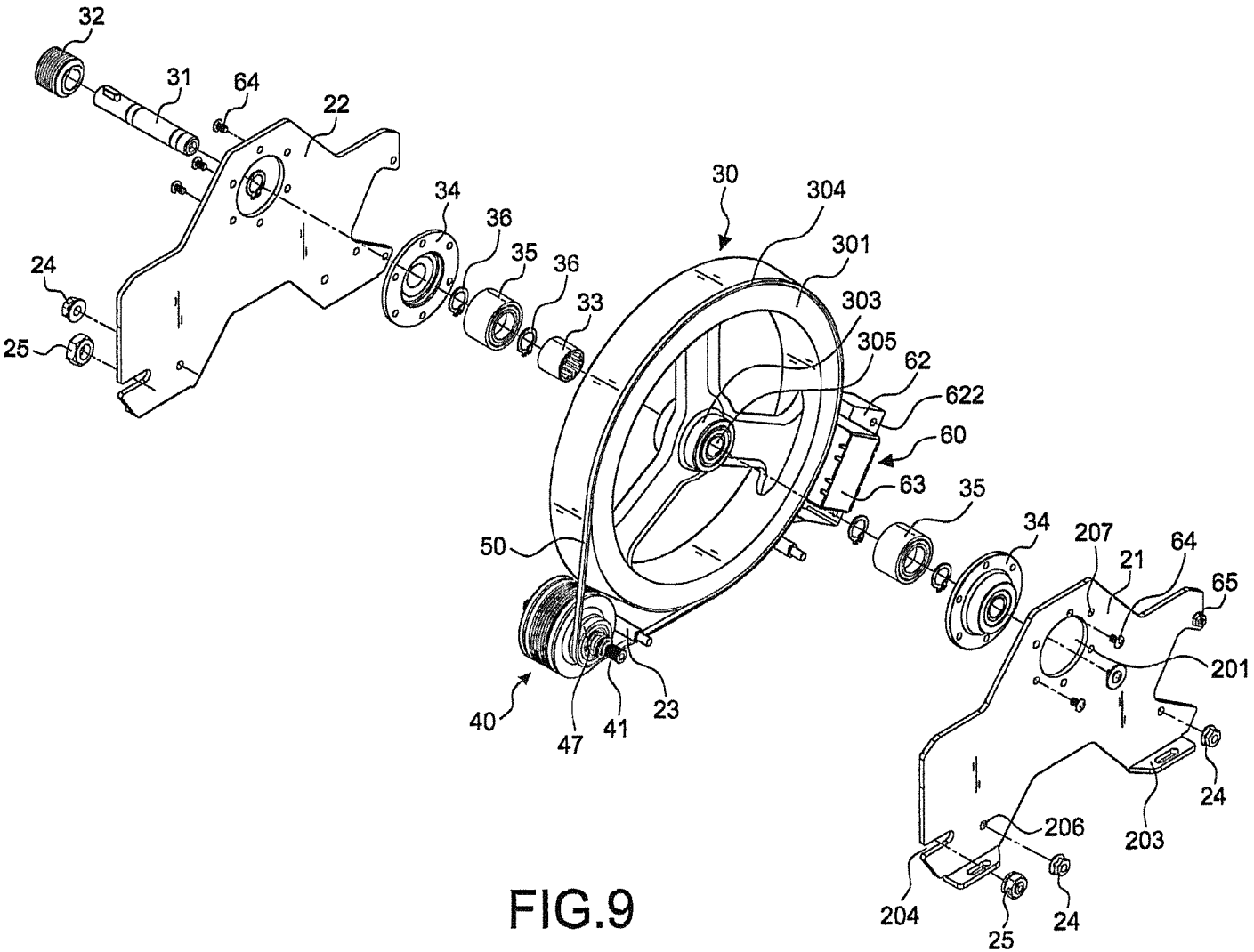
FIG. 9 is an exploded view of a second preferred embodiment of the present invention.
Figure 10:
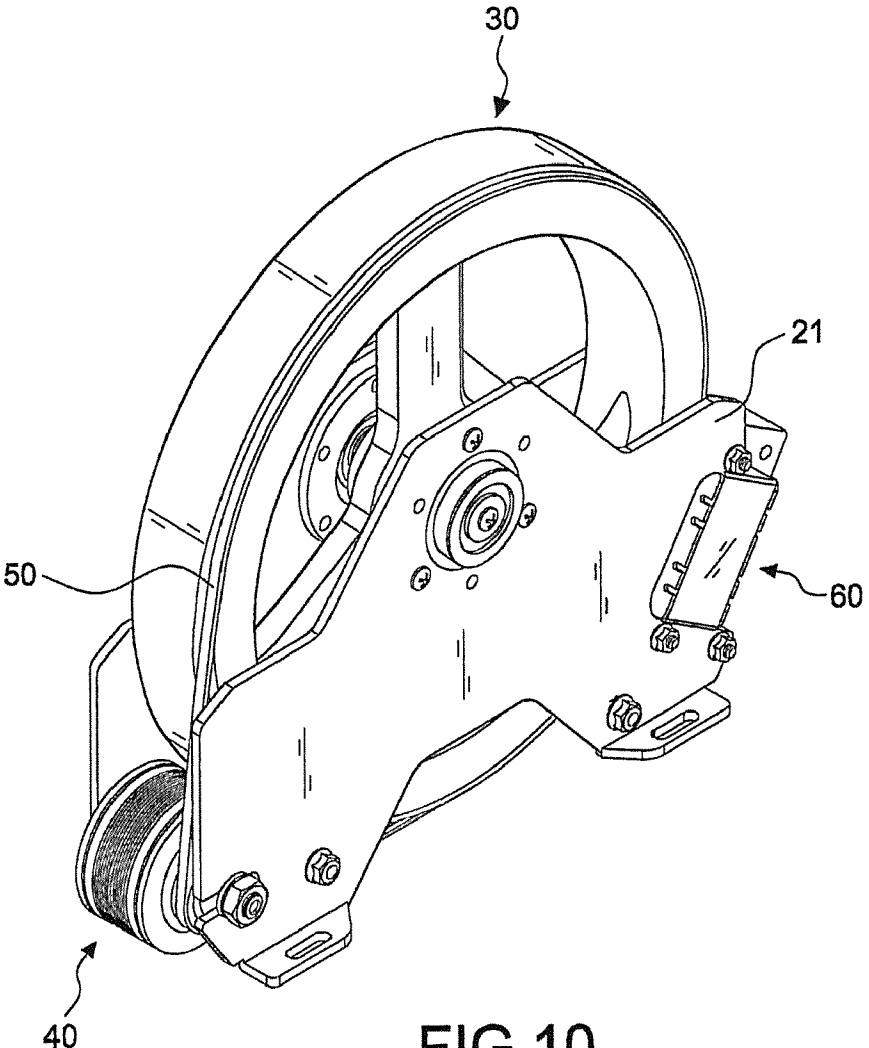
FIG. 10 is a perspective view of a second preferred embodiment of the present invention.

With reference to FIGS. 9 and 10 for a second preferred embodiment of the present invention, the numerals used for representing elements of this preferred embodiment are the same as those of the first preferred embodiment, and the method of the mechanical transmission, the structure of the power generator, and the characteristic of the resistance mechanism of the second preferred embodiment are substantially the same as those of the first preferred embodiment, and the difference resides on the resistance mechanism 60 only. In this preferred embodiment, the resistance mechanism 60 is installed on an external side of the flywheel 30, and the shape of the external plates 21, 22 is changed to match with the fixing method of the resistance mechanism 60, the flywheel 30 and the bracket 20, but their functions remain unchanged.

In this preferred embodiment, the resistance mechanism 60 comprises a braking iron core 62 having a containing portion 621 substantially E-shaped and concavely formed on an internal surface of the braking iron core 62 and a solenoid 63 installed thereon; a braking iron core 62, having a screw hole 622 formed on an external side of the braking iron core 62, and a fixing screw 64 for fixing the braking iron core 62 onto the internal plate 21, while a magnetic gap is formed between the braking iron core 62 and the external periphery of the external ring 301 of the flywheel 30 to produce a magnetic resistance effect; and the external ring 301 of the flywheel 30 is made of a magnetic material, or a magnetic material is coated onto the surface of the external periphery to achieve effect of using a solenoid 63 to produce a closed magnetic circuit. In this preferred embodiment, a set of braking iron core 62 and solenoid 63 is installed, but the present invention is not limited to one set only.

Figure 11:
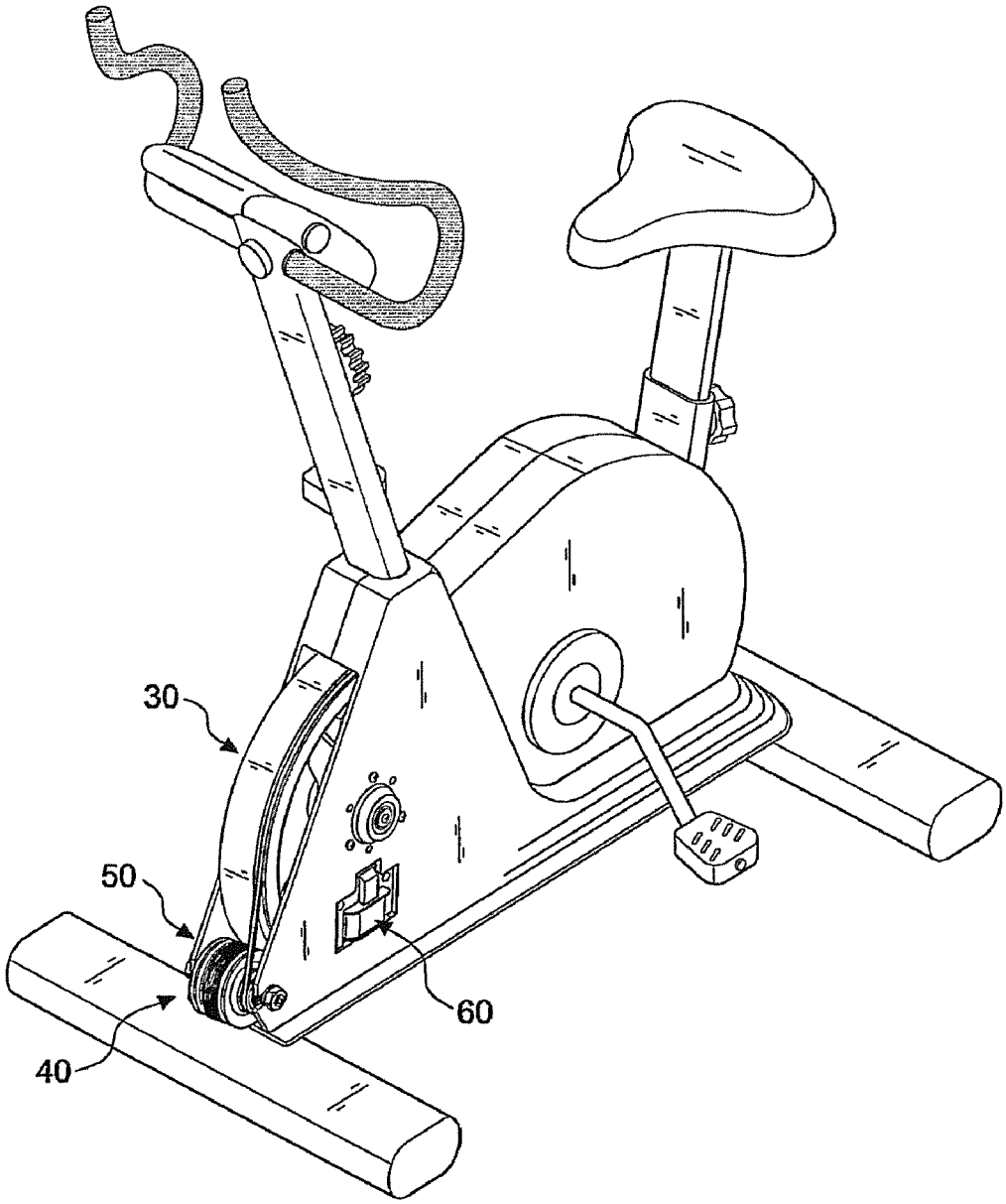
FIG. 11 is a perspective view of a third preferred embodiment of the present invention.

With reference to FIG. 11 for a third preferred embodiment of the present invention, the method of the mechanical transmission, the structure of the power generator, and the characteristic of the resistance mechanism are substantially the same as those of the first preferred embodiment, and the difference resides on that the frame of the fitness equipment or rehabilitation equipment acts as the bracket provided for mounting the flywheel, the power generator and the resistance mechanism onto the frame directly.

In the present invention, the power generator 40 is installed at an external side of the flywheel 30, such that the structure of the power generator will not be affected by the size of the flywheel, and the power generator can be disposed outside the flywheel independently, and such arrangement becomes a standard specification that can lower the manufacturing cost effectively. In addition, the power of the power generator is directly proportional to the rotating speed of the power generator, so that the external diameter of the flywheel can be increased according to a customer requirement to increase the rotating speed ratio of the power generator, so as to improve the output of the power and the power generating efficiency. In addition, the exercise resistance of the fitness and rehabilitation equipments is provided by the self-generating current of the power generator, and the resistance mechanism can be installed at the internal side or external side of the flywheel according to the size of the flywheel, such that the apparatus of the invention can be applied to various different models of equipments flexibly.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A self-generating resistance apparatus for fitness and rehabilitation equipments, comprising:

a bracket, formed by assembling an internal plate and an external plate, and having an upper end with a shaft hole formed thereon and a lower end fixed to a frame of a fitness equipment or a rehabilitation equipment;

a flywheel, being a rotating means for providing inertia, and having an external ring and a hub, and a ring groove being formed at an external edge of the external ring;

a rotating axle, passed into a hub of the flywheel, and having a bearing and a bearing seat installed on the rotating axle, and the rotating axle being installed into the shaft hole of the bracket, and an end of the rotating axle having a driven wheel driven by a driving wheel of the fitness equipment or the rehabilitation equipments for driving the rotating axle and the flywheel to rotate;

a power generator, installed outside the flywheel, and having a shaft and a power generator, and the power generator further having a pulley fixed to an external side of the power generator, and both ends of the shaft being secured onto the internal and external plates of the bracket respectively; and a belt, mounted onto the ring groove of the flywheel and the pulley of the power generator, such that the flywheel can drive the power generator to rotate and generate an electric current;

thereby, a user of the fitness equipment or the rehabilitation equipment can step on the equipment, and the kinetic energy is transmitted from the flywheel to the power generator, and the external ring of the flywheel has a diameter much greater than the diameter of the pulley of the power generator, such that when the flywheel rotates, a large speed ratio between the power generator and the flywheel is formed, and the electric current generated by the power generator is increased correspondingly;

a resistance mechanism, including a braking iron core and a solenoid, and the braking iron core having an E-shaped containing portion concavely formed on an internal surface of the braking iron core and provided for installing the solenoid, and the resistance mechanism being installed at the periphery of the flywheel, and the electric current generated by the power generator being supplied to the solenoid, the braking iron core and the flywheel to produce a closed magnetic circuit, so as to produce a reverse resistance to the rotating flywheel.

2. The self-generating resistance apparatus for fitness and rehabilitation equipments as recited in claim 1, wherein the power generator comprises a magnet cover, which is a hollow ring with a permanent magnet installed inside the hollow ring, and a front cover and a rear cover are mounted onto both distal surfaces at both ends of the magnet cover respectively, and an external side of the front cover and the pulley are combined into one piece, and a bearing hole is formed at the center of each of the front and rear covers for installing a bearing, and the bearing is installed onto the shaft, such that the magnet forms a rotor; a stator, fixed onto the shaft, and having a power generating coil wound around the external periphery of the stator, such that the pulley is driven by the flywheel through the belt, and the magnet inside the magnet cover is rotated together with the pulley, and the magnetic field is changed, such that the electromagnetic force induced by the power generating coil in the stator to generate an electric current.

3. The self-generating resistance apparatus for fitness and rehabilitation equipments as recited in claim 2, wherein the braking iron core and the solenoid of the resistance mechanism come with one set or plural sets.

4. The self-generating resistance apparatus for fitness and rehabilitation equipments as recited in claim 3, wherein the resistance mechanism is installed inside the flywheel, and a small gap is formed between an external surface of the braking iron core and an external surface of the external ring of the flywheel.

5. The self-generating resistance apparatus for fitness and rehabilitation equipments as recited in claim 4, wherein the external ring of the flywheel has an internal wall for containing the resistance mechanism, and the resistance mechanism further comprises a braking iron core bracket having an end for installing the braking iron core and the solenoid, and the braking iron core bracket is fixed onto the bracket.

6. The self-generating resistance apparatus for fitness and rehabilitation equipments as recited in claim 3, wherein the resistance mechanism is installed outside the flywheel, such that a small gap is formed between an external surface of the braking iron core and an external surface of the external ring of the flywheel.

7. The self-generating resistance apparatus for fitness and rehabilitation equipments as recited in claim 6, wherein the braking iron core is secured onto the bracket.

8. The self-generating resistance apparatus for fitness and rehabilitation equipments as recited in claim 1, wherein the internal and external plates of the bracket are coupled as one piece by locking a plurality of nuts onto both ends of two or more positioning rods respectively, and each of the internal and external plates of the bracket has an open slot for securing a shaft of the power generator and adjusting the tightness of the belt.

9. The self-generating resistance apparatus for fitness and rehabilitation equipments as recited in claim 5, wherein the internal plate of the bracket has a maintenance hole formed thereon for maintaining the braking iron core and the solenoid when needed.

10. The self-generating resistance apparatus for fitness and rehabilitation equipments as recited in claim 1, wherein the bracket is a frame of the fitness equipment and rehabilitation equipment and provided for securing the flywheel, the power generator and the resistance mechanism.

* * * * *